US009863611B2

(12) United States Patent
Gutekunst et al.

(10) Patent No.: US 9,863,611 B2
(45) Date of Patent: Jan. 9, 2018

(54) SIGNAL COLUMN

(71) Applicant: Balluff GmbH, Neuhausen a. d. F. (DE)

(72) Inventors: Juergen Gutekunst, Nuertingen (DE); Viktor Virág, Gyoer (HU); Kristof Simon, Veszprém (HU); Henrik Ruf, Neuhausen (DE)

(73) Assignee: Balluff GmbH, Neuhausen a. d. F. (DE)

( * ) Notice: Subject to any disclaimer, the term of this patent is extended or adjusted under 35 U.S.C. 154(b) by 0 days.

(21) Appl. No.: 14/647,489

(22) PCT Filed: Nov. 25, 2013

(86) PCT No.: PCT/DE2013/000692
§ 371 (c)(1),
(2) Date: May 27, 2015

(87) PCT Pub. No.: WO2014/082616
PCT Pub. Date: Jun. 5, 2014

(65) Prior Publication Data

US 2015/0300606 A1 Oct. 22, 2015

(30) Foreign Application Priority Data

Nov. 28, 2012 (DE) ..... 10 2012 023 190

(51) Int. Cl.
*F21V 15/01* (2006.01)
*F21V 17/06* (2006.01)
(Continued)

(52) U.S. Cl.
CPC ..... *F21V 17/06* (2013.01); *F21S 8/00* (2013.01); *F21V 3/04* (2013.01); *F21V 15/01* (2013.01);
(Continued)

(58) Field of Classification Search
CPC .. F21V 3/04; F21V 17/06; F21V 15/01; F21S 8/00; G08B 21/18; G08B 5/36; F21W 2131/40; F21W 2131/403
(Continued)

(56) References Cited

U.S. PATENT DOCUMENTS 3,868,682 A 2/1975 Simon et al.
5,081,568 A * 1/1992 Dong ..... F21L 4/02 340/321
(Continued)

FOREIGN PATENT DOCUMENTS

DE 2 211 801 A1 9/1972
DE 195 13 983 A1 10/1995
(Continued)

OTHER PUBLICATIONS

International Search Report of PCT/DE2013/000692, dated May 9, 2014.
(Continued)

*Primary Examiner* — Anh Mai
*Assistant Examiner* — Arman B Fallahkhair
(74) *Attorney, Agent, or Firm* — Collard & Roe, P.C.

(57) ABSTRACT

A signal column includes a rod-shaped, transparent housing, inside of which a rod-shaped signal generator is arranged. At least one light distribution element is arranged in the housing between the signal generator and the transparent housing, wherein the light distribution element directs light evenly from light sources of the signal generator to the housing wall.

10 Claims, 3 Drawing Sheets

(51) Int. Cl.

| | |
|---|---|
| ***F21S 8/00*** | (2006.01) |
| ***G08B 5/36*** | (2006.01) |
| ***G08B 21/18*** | (2006.01) |
| ***F21V 3/04*** | (2006.01) |
| *F21W 131/40* | (2006.01) |
| *F21W 131/403* | (2006.01) |
| *F21W 111/00* | (2006.01) |
| *F21Y 103/10* | (2016.01) |
| *F21Y 115/10* | (2016.01) |
| *F21Y 107/40* | (2016.01) |

(52) U.S. Cl.
CPC ..... *G08B 5/36* (2013.01); *G08B 21/18* (2013.01); *F21W 2111/00* (2013.01); *F21W 2131/40* (2013.01); *F21W 2131/403* (2013.01); *F21Y 2103/10* (2016.08); *F21Y 2107/40* (2016.08); *F21Y 2115/10* (2016.08)

(58) Field of Classification Search
USPC ..... 362/235, 232, 101, 161, 102
See application file for complete search history.

(56) References Cited

U.S. PATENT DOCUMENTS

| | | | | |
|---|---|---|---|---|
| 5,335,157 | A * | 8/1994 | Lyons | B60Q 1/2611 362/297 |
| 5,412,548 | A * | 5/1995 | Yee | F21L 4/005 362/186 |
| 5,622,423 | A | 4/1997 | Lee | |
| 5,697,695 | A * | 12/1997 | Lin | F21L 4/02 340/321 |
| 5,890,794 | A | 4/1999 | Abtahi et al. | |
| 5,952,915 | A | 9/1999 | Marquardt et al. | |
| 6,572,242 | B2 | 6/2003 | Marquardt et al. | |
| 6,646,813 | B2 * | 11/2003 | Falicoff | G02B 6/0035 359/641 |
| 6,783,269 | B2 * | 8/2004 | Pashley | G02B 6/001 362/23.15 |
| 7,006,306 | B2 * | 2/2006 | Falicoff | G02B 3/04 359/642 |
| 7,132,785 | B2 * | 11/2006 | Ducharme | F21K 9/00 313/485 |
| 7,140,746 | B2 * | 11/2006 | Chen | F21L 4/02 362/183 |
| 7,195,370 | B2 * | 3/2007 | Riblett | F21L 4/02 362/102 |
| 7,267,453 | B2 * | 9/2007 | Chang | A45B 3/04 361/232 |
| 7,422,355 | B2 * | 9/2008 | Hirata | F21S 6/001 362/161 |
| 7,611,254 | B1 * | 11/2009 | Yu | A63H 23/005 362/101 |
| 8,395,526 | B2 | 3/2013 | Kensy et al. | |
| 8,456,322 | B2 | 6/2013 | Marquardt et al. | |
| 2005/0129204 | A1 | 6/2005 | Arcaria et al. | |
| 2007/0177393 | A1 | 8/2007 | Hirata | |
| 2009/0323315 | A1 | 12/2009 | Tuite et al. | |
| 2010/0048097 | A1 * | 2/2010 | Ma | A63H 33/009 446/473 |
| 2013/0039051 | A1 * | 2/2013 | Wu | F21V 31/00 362/218 |
| 2013/0222123 | A1 | 8/2013 | Wessling | |

FOREIGN PATENT DOCUMENTS

| | | | |
|---|---|---|---|
| DE | 202 04 206 | U1 | 7/2002 |
| DE | 10 2009 051 412 | A1 | 5/2010 |
| DE | 10 2009 013 303 | A1 | 9/2010 |
| DE | 10 2010 025515 | A1 | 12/2011 |
| DE | 20 2009 018 539 | U1 | 3/2012 |
| EP | 1 146 278 | A2 | 10/2001 |
| EP | 2 187 278 | A1 | 5/2010 |

OTHER PUBLICATIONS

English translation of the relevant part of IMOS Optics for industry, Lichtverteilfolie F002 (technical data sheet No. 74.02) by IMOS Gubela GmbH, Renchen.

"IO-Link Overview" downloaded on Aug. 12, 2016 from http://www.io-link.com/en/Technology/what_is_IO-Link.php?thisID=76.

Chinese Office Action in CN 201380060049.X, dated Nov. 11, 2016.

IMOS Light Distribution Sheeting F002 (technical data sheet 74.02), IMOS Gubela GmbH, Renchen, Germany, Jul. 7, 2007.

German Office Action in DE 10 2012 023 190.3 dated Sep. 12, 2017 with English translation of relevant parts.

* cited by examiner

SIGNAL COLUMN

CROSS REFERENCE TO RELATED APPLICATIONS

This application is the National Stage of PCT/DE2013/000692 filed on Nov. 25, 2013, which claims priority under 35 U.S.C. §119 of German Application No. 10 2012 023 190.3 filed on Nov. 28, 2012, the disclosure of which is incorporated by reference. The international application under PCT article 21(2) was not published in English.

The invention relates to a signal column with a rod-shaped, transparent housing, inside of which a rod-shaped signal generator is arranged.

STATE OF THE ART

Such signal columns, also known as "stacklights", serve for the optical display of at least one operational status, particularly for the display of multiple different operational statuses of technical devices, such as machines, systems, vehicles, or the like. Such light columns follow from DE 10 2009 051 412 A1, US 2005/0129204 A1, DE 20 2009 018 539 U1, for example.

In DE 2 211 801, a light column is disclosed that comprises at least partially transparent light elements, which respectively comprise one light bulb and are arranged in a manner stacked on top of each other and are arranged on a socket. The light elements are interconnected by means of leads.

From DE 195 13 983 A1, a signal column has become known which is comprised of multiple signal elements that are identical in their construction and are arranged on top of each other. In order to achieve a simple and effective mechanical and electrical connection, a bayonet-type fastening assembly is provided between the signal elements or the electrical connection socket, wherein a connection to an L-shaped connecting web of respectively neighboring parts is made via U-shaped connecting bridges. Hereby, the signal elements can be easily separated at any desired position of the signal column, so that an exchange of signal generators or an exchange of individual signal elements with different color schemes is possible. As illuminants, also so-called LED columns are used in order to create a kind of omnidirectional beacon. Here, multiple, for example four, LEDs are arranged in a perpendicular manner on top of each other so as to form six LED columns, for example, which are arranged in the manner of a hexagon. In order to generate a collimated light beam, LEDs with a small radiation angle are used.

At this, the LEDs are respectively arranged in a signal element.

In these signal columns, as they are known from the state of the art, multiple signal elements are interconnected and electrically contacted. These signal elements may have different colors, different luminosities, and the like. One thing that is problematic here is that different signal elements have to be connected to each other mechanically or electrically. This does not only increase the assembly effort, but also creates potential for error sources, such as for example electrical mismating, entry of dirt when the signal elements are disassembled, and the like. Moreover, the types of design for such signal lights are limited due to the signal elements ("stacklight") that are arranged on top of each other in a stacked manner.

The invention is based on the objective to provide a further development of a signal light of the generic type, namely in such a way that a large number of different signal display options is realizable while at the same time an easy assembly is provided.

DISCLOSURE OF THE INVENTION

The signal column according to the invention has the advantage that at least one light guide element, guiding the light substantially in a plane-like manner from light sources of the signal generator to the housing wall, is arranged inside the housing between the signal generator and the transparent housing.

This embodiment makes it possible to manufacture the signal column as a single structural element, wherein the signal generator reaches from the base of the housing to the cover element, as it were, inside of the rod-shaped housing. Thanks to the at least one light distribution element (light guide element), which guides the light in a plane-like manner from the light sources of the signal generator to the housing wall, it is possible to realize different signal levels, without the signal elements having to be mechanically arranged on top of each other. Rather, different signal levels can be realized across the entire length of the signal column due to the rod-shaped signal generator that comprises column-like light sources arranged on top of each other in connection with the at least one light distributor element.

By means of the measures detailed in the disclosure, advantageous further developments and enhancements of the signal column are possible. It is particularly advantageous that the at least one light distribution element is a light distributor foil.

This light distributor foil is preferably attached to the interior of the housing wall. Here, it is preferably provided that the light distributor foil substantially follows the shape of the housing wall. As the light foil, the "IMOS Lichtverteilfolie F002" (technical data sheet No 74.02) by IMOS Gubela GmbH, Renchen, can be used, for example.

For the purpose of attaching the foil inside the housing, at least one attachment element that is protruding into the interior of the housing is advantageously provided. According to an advantageous embodiment, the at least one attachment element is embodied as a projection which forms two grooves that are facing each other together with the housing wall, receiving and holding the foil ends.

In principal, the rod-shaped transparent housing can have a different shape. Preferably this housing is a prism.

Advantageously, the prism has a polygonal, particularly a triangular, base with even or bent side surfaces.

The signal generators can be embodied in different ways. In a very advantageous embodiment it is provided that the signal generator has at least one LED column. What is understood here by an LED column is a column-like arrangement of LEDs that are lying on top of each other. Preferably, the signal generator comprises multiple LED columns that are arranged in such a manner that the light emitted by them is radiated in all spatial directions. Preferably, the LED columns are arranged in such a manner that their light radiates in the direction of the side surfaces of the prism with the polygonal base.

It is particularly advantageous if the LED columns are formed by RGB LEDs. These RGB LEDs facilitate a practically unlimited color choice. Hereby, signal columns with a plurality of a variety of different signal elements can be realized, wherein these signal elements are realized electronically, meaning that they do not have to be connected by means of individual structural components as they are known from the state of the art.

In one embodiment it is provided that the RGB LEDs are arranged so that they lie on top of each other on elongated printed circuit board elements which are respectively flexibly connected to each other and are positioned vertically inside the housing.

The RGB LEDs can be controlled by means of a control circuit in terms of their illumination time, illumination duration, color and brightness.

The signal column preferably comprises an IO link interface or an IO link adapter. By means of this interface or this adapter, the signal column can be connected to a master assembly.

The energy supply of the signal column is advantageously realized via the IO link, as well. The connection by means of IO links is advantageous because the wiring effort is considerably reduced in this manner. Moreover, thanks to the standardized IO link interface, it is possible to connect the signal column to different machines, processes and the like. Thus, activation or energy supply of the signal column does not have to be individually adjusted to different machines, and the like.

SHORT DESCRIPTION OF THE DRAWINGS

Embodiments of the invention are shown in the drawings and are explained in more detail in the following description.

Herein:

EMBODIMENTS OF THE INVENTION

Figure 1:
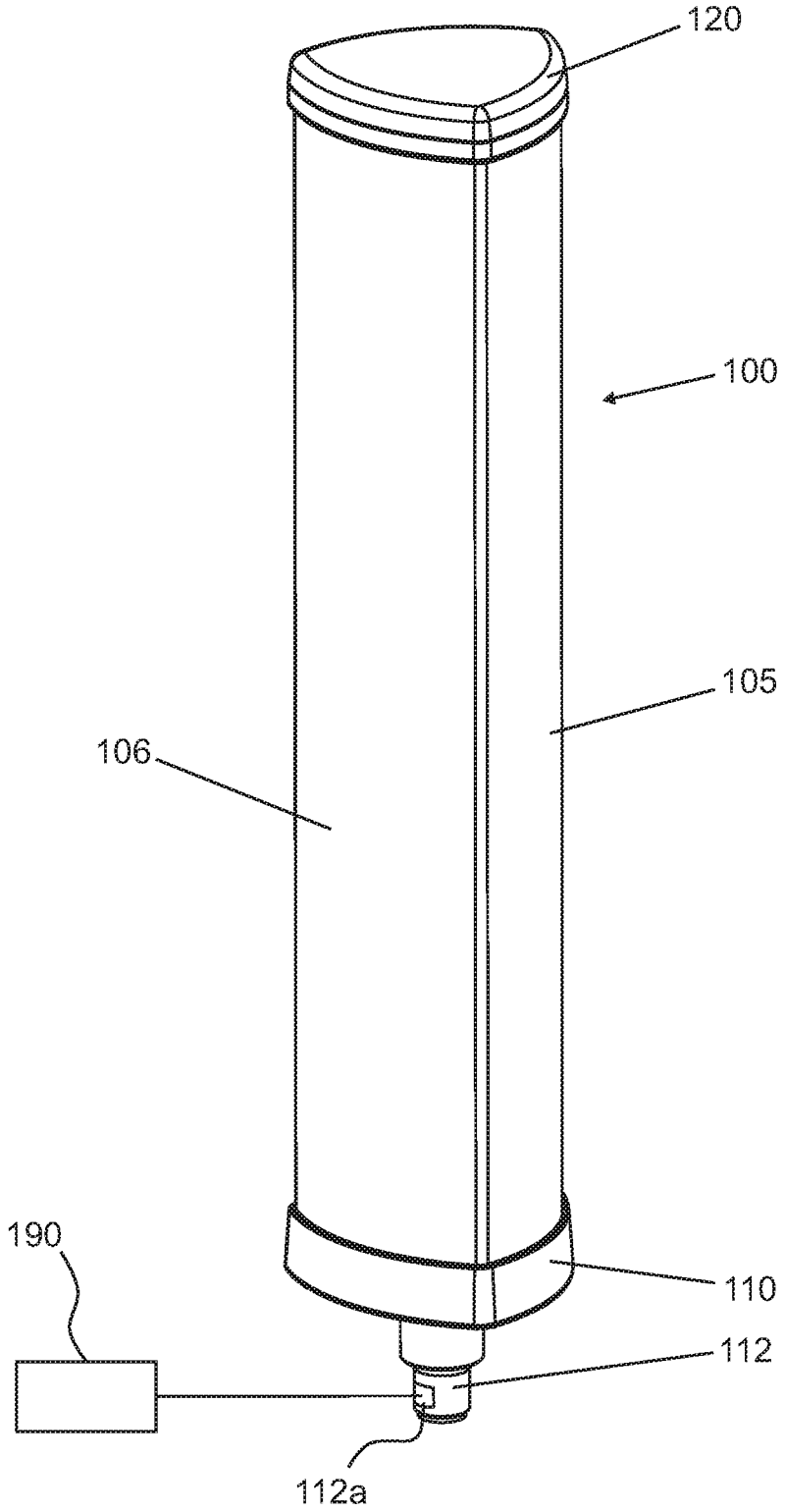
FIG. 1 shows an isometric rendering of a signal column according to the invention.

A signal light 100, shown in FIG. 1, comprises a rod-shaped transparent housing, which is formed as a prism with a substantially triangular base and bent side surfaces 105, 106 and 107 that form the housing wall. The housing comprises a socket element 110 as well as a cover element 120, which can be made of plastic or metal material, for example. A connector element 112, e.g. for electric leads, including a single-drop communication interface 112*a* for small sensors and actuators (SDCI) is provided in the socket element 110. The socket element further serves for attaching the signal column to a machine, and the like. The connector element 112 comprises an IO link interface or an IO link adapter, for example, in order to attach the signal column to the master assembly 190. Not only the control signals are transmitted via this IO link connection, but it also serves in a very advantageous manner for supplying energy to the signal column.

Together with the housing wall that is formed as a single part and comprises the bent side surfaces 105, 106, 107, a fastening element is arranged inside the housing, for example at the transition of two side surfaces 105 and 107, namely in the form of a projection comprising nibs 170 which, together with the housing walls 107, 105, respectively form grooves 171, 172 inside of which the ends of a light distributor foil (to be described below) are received.

Figure 2:
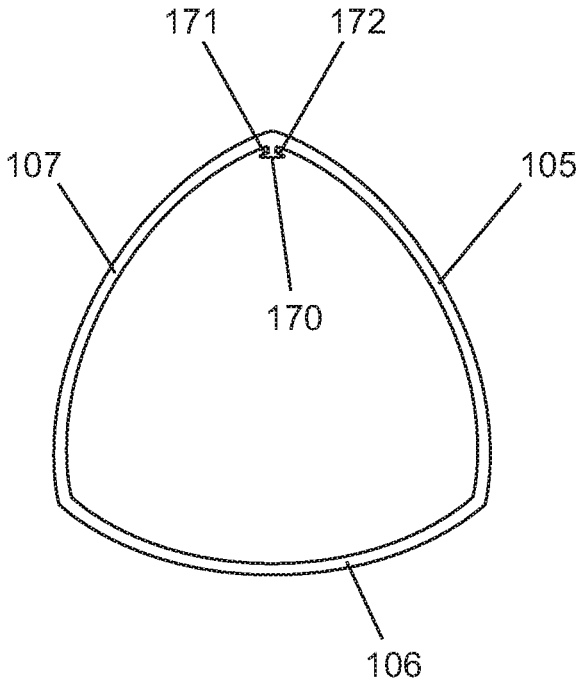
FIG. 2 shows a sectional view through the housing of the signal column shown in FIG. 1.
Figure 3:
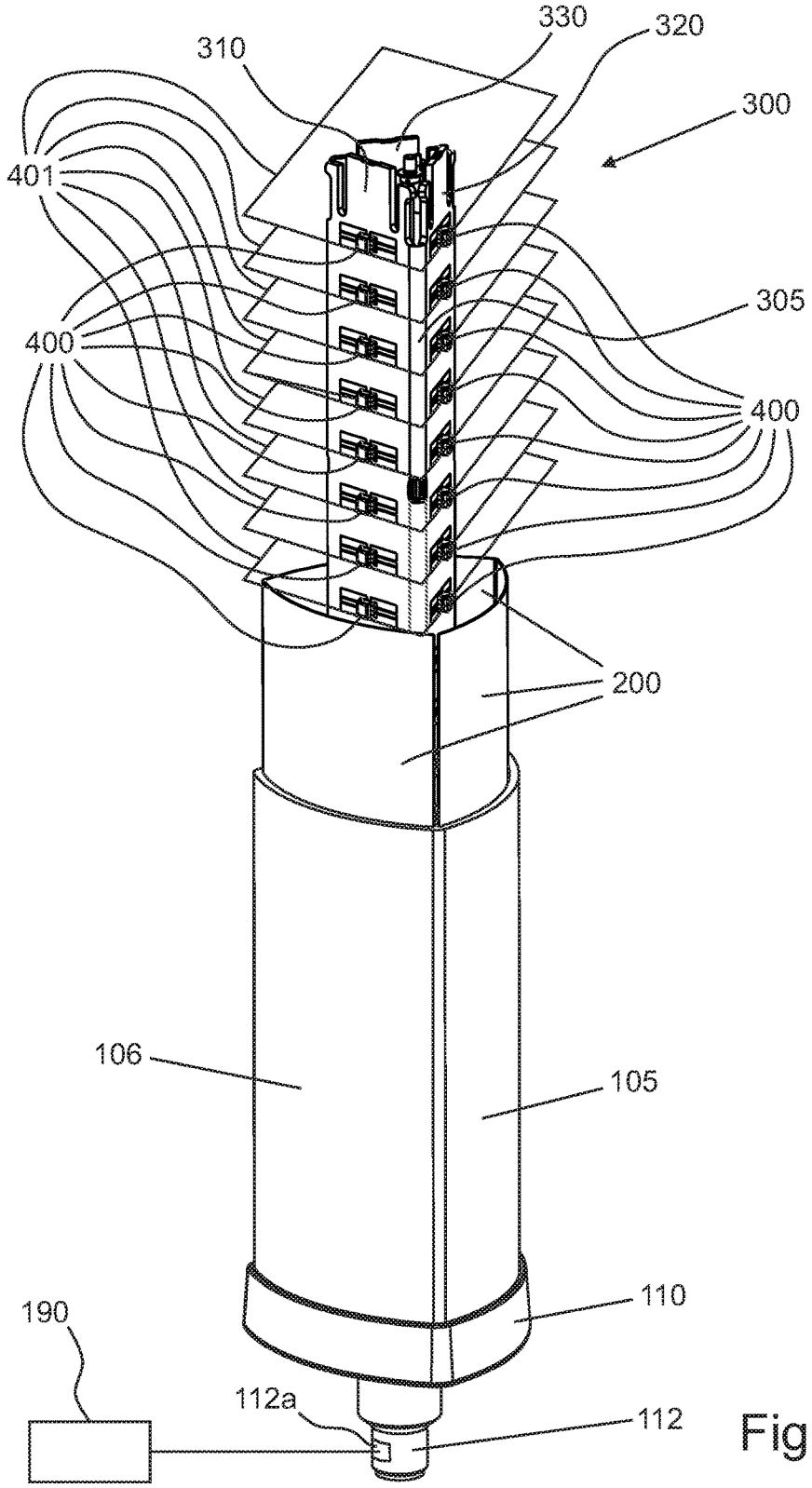
FIG. 3 shows an isometric rendering of the signal column shown in FIG. 1, partly broken away in order to convey its structure more clearly.

The structure of the signal column is described in more detail in connection with FIG. 3, with FIG. 3 showing the signal column illustrated in FIG. 1 in a partially broken away rendering. As can be seen from FIG. 3, the light distributor foil 200 is arranged inside the housing in such a manner that it substantially follows the housing walls, or, to put it differently, that it extends along the housing walls. The foil is either arranged inside the housing as a one-piece foil and is correspondingly bent, or individual foil elements are provided through flexible connecting elements. Here, it has to be stressed that in principle the fastening element 170 described above can also be provided at each transition of the curved side surfaces, that is, also at the transition between the side surfaces 105 and 106, as well as 106 and 107 (see FIG. 2). In this latter case, individual foil elements can correspondingly be attached to the interior of the housing wall 105, 106, 107. As for the foil itself, it can e.g. be an "IMOS Lichtverteilfolie F002" by IMOS Gubela GmbH, Kniebisstr. 1, 77871 Renchen, as it follows from the technical data sheet Nr. 74.02.

Inside the housing, a rod-shaped signal generator 300 is arranged. The rod-shaped signal generator can be formed by three elongated printed circuit boards 310, 320, 330, for example, which are connected to each other via flexible connections 305 in the manner of a triangular-shaped prism. At the outsides of the printed circuit boards, RGB LEDs 400 are arranged lying on top of each other, respectively, so that each printed circuit board 310, 320, 330 forms an LED column. The light emitted by these RGB LEDs is in a plane-like manner guided through the light distributor foil 200 to the transparent housing sides. Through this horizontal light guiding, a light pattern is facilitated which is lying one above the other in a "stacked-like" manner in which the light is directed in a series of stacked planes 401. The RGB LEDs can be controlled via a control circuit (which is not shown) with regard to their illumination time, meaning the time illumination starts and the time illumination ends, their illumination duration, their color and their brightness. In this way, practically any desired number of different light patterns can be achieved in a purely electronic manner. Thus, a per se known signal light can be realized with three colors green, yellow, red, arranged one above the other, for example; or a blue light generating an rotating light by an overlapping serial connection of the different light-emitting diodes, or a blinking light, or a rising and falling light pattern, and the like. As has already been mentioned above, control is performed here via an IO link interface or an IO link adapter, that is, in a standardized manner. Hereby, not only the versatility of the application possibilities of the signal column is increased, but also the wiring effort and thus the possible sources of disturbance are considerably reduced.

The great advantage is that the different light elements do not have to be mechanically connected to each other, which is very advantageous particularly with regard to density and interference resistance. Moreover, a variety of different light figures can be generated.

The invention claimed is:

1. Signal column, comprising:

a rod-shaped transparent housing comprising a housing wall, wherein the housing is a prism having a polygonal base with even or bent side surfaces that form the housing wall, a rod-shaped signal generator arranged inside the transparent housing and comprising a plurality of LED columns formed by RGB LEDs arranged lying on top of each other on elongated printed circuit board elements that are flexibly connected to each other and that are positioned vertically inside the housing, the RGB LEDs radiating in a direction of the side surfaces of the prism, a light distribution foil arranged in the transparent housing between said signal generator and said transparent housing, the light distribution foil extending vertically in the housing and comprising a plurality of light dispersing bodies, and a fastening element protruding into the interior of the housing and comprising a projecting nib forming a first groove and a second groove disposed opposite from the first groove, the projecting nib extending along the length of the housing, wherein said light dispersing bodies direct light emitted from the RGB LEDs of the signal generator to the housing wall in a light pattern of a series of stacked planes one above the other, wherein the first groove of the projecting nib receives a peripheral edge of the light distribution foil at a first foil end of the light distribution foil along the length of the light distribution foil in a mating manner so that the light distribution foil is attached at an inside of the housing wall, and wherein the light distribution foil substantially follows the shape of the housing wall.

2. Signal column according to claim 1, further comprising a single-drop digital communication interface for small sensors and actuators (SDCI).

3. Signal column according to claim 2, wherein an energy supply of the signal column is realized via the single-drop digital communication interface for small sensors and actuators (SDCI).

4. Signal column according to claim 1, wherein the prism has a triangular base.

5. Signal column according to claim 1, wherein the RGB LEDs can be controlled by a control circuit in terms of their illumination time, their illumination duration, their color and their brightness.

6. Signal column according to claim 1, wherein said plurality of light dispersing bodies comprises a plurality of microlens surfaces.

7. Signal column according to claim 1, wherein the second groove of the projecting nib receives a peripheral edge of the light distribution foil at a second foil end of the light distribution foil along the length of the light distribution foil in a mating manner.

8. Signal column according to claim 1, further comprising a plurality of the light distribution foils and a plurality of the fastening elements, wherein the grooves of the fastening elements receive a respective peripheral edge of the light distribution foils at a respective foil end of the light distribution foils along the length of the light distribution foil in a mating manner so that the light distribution foils are attached at the inside of the housing wall, and wherein the light distribution foils substantially follow the shape of the housing wall.

9. A system, comprising:

a signal column, comprising:

a rod-shaped transparent housing comprising a housing wall, wherein the housing is a prism having a polygonal base with even or bent side surfaces that form the housing wall, a rod-shaped signal generator arranged inside the transparent housing and comprising a plurality of LED columns formed by RGB LEDs arranged lying on top of each other on elongated printed circuit board elements that are flexibly connected to each other and that are positioned vertically inside the housing, the RGB LEDs radiating in a direction of the side surfaces of the prism, a light distribution foil arranged in the housing between said signal generator and said transparent housing, the light distribution foil extending vertically in the housing and comprising a plurality of light dispersing bodies, and a fastening element protruding into the interior of the housing and comprising a projecting nib forming a first groove and a second groove disposed opposite from the first groove, the projecting nib extending along the length of the housing;

a master assembly; and a single-drop digital communication interface for small sensors and actuators (SDCI), the single-drop digital communication interface connecting the signal column to the master assembly;

wherein said light dispersing bodies direct light emitted from the RGB LEDs of the signal generator to the housing wall in a light pattern of a series of stacked planes one above the other;

wherein the first groove of the projecting nib receives a peripheral edge of the light distribution foil at a first foil end of the light distribution foil along the length of the light distribution foil in a mating manner so that the light distribution foil is attached at an inside of the housing wall; and wherein the light distribution foil substantially follows the shape of the housing wall.

10. The system according to claim 9, wherein said plurality of light dispersing bodies comprises a plurality of microlens surfaces.

* * * * *